United States Patent [19]

Remy et al.

[11] Patent Number: 4,555,924

[45] Date of Patent: Dec. 3, 1985

[54] AUTOMATIC MACHINE FOR CURVING, IN A SPATIAL CONFIGURATION, THIN AND RECTILINEAR METAL ELEMENTS, MORE ESPECIALLY METAL WIRES

[75] Inventors: Michel N. Remy, Raon l'Etape; Jean-François Delaite, Saint Michel sur Meurthe; Guy J. Woirgard, Baccarat, all of France

[73] Assignee: Autocoussin, Paris, France

[21] Appl. No.: 562,474

[22] Filed: Dec. 16, 1983

[51] Int. Cl.[4] ..... B21D 7/02

[52] U.S. Cl. ..... 72/307; 72/384; 140/104; 140/105

[58] Field of Search ..... 72/307, 388, 387, 384, 72/306; 140/104, 80, 105

[56] References Cited

U.S. PATENT DOCUMENTS

| | | | |
|---|---|---|---|
| 3,045,740 | 7/1962 | Davis | 72/388 |
| 3,181,323 | 5/1965 | Bos | 72/307 |
| 3,373,587 | 3/1968 | Shubin et al. | 72/7 |
| 3,393,714 | 7/1968 | Ott | 72/306 |
| 3,493,016 | 2/1970 | Ott | 72/7 |
| 3,857,271 | 12/1974 | Gott et al. | 72/384 |
| 4,072,036 | 2/1978 | Del Fabro | 140/105 |

FOREIGN PATENT DOCUMENTS

| | | | |
|---|---|---|---|
| 1335279 | 7/1963 | France | 140/80 |
| 39464 | 11/1971 | Japan | 140/104 |

*Primary Examiner*—Daniel C. Crane

*Attorney, Agent, or Firm*—Romney Golant Martin & Ashen

[57] ABSTRACT

This machine includes a feed device (13) through which a metal element (1) to be curved is advanced with a stepped feeding movement. A bending device is situated downstream and in the vicinity of the feed-device outlet. The bending device can be rotated about a first axis perpendicular to the feed direction and about a second axis parallel to the feed direction, and can also be reciprocated parallel to the first axis. Preferably the bending means thus rotate about the metal element (1), which is secured against rotation.

16 Claims, 4 Drawing Figures

AUTOMATIC MACHINE FOR CURVING, IN A SPATIAL CONFIGURATION, THIN AND RECTILINEAR METAL ELEMENTS, MORE ESPECIALLY METAL WIRES

BACKGROUND

1. Field of the Invention

This invention relates generally to automatic machinery for cambering or curving, in accordance with a predetermined configuration, thin rectilinear metal elements of constant thickness, such as wires, tubes, or metal strips.

2. Description of the Related Art

Machines are known which feed metal wires and the like stepwise from a distributor means to a bending means, just downstream, which is rotated by one drive mechanism about an axis perpendicular to the feed direction and reciprocated by a second drive mechanism along a linear path parallel to this axis. The first and second drive mechanisms are synchronized with the feed device in a predetermined operational sequence.

Curving machines of this type are popular because of their automatic operation and because they make it possible to curve wires and the like continuously.

The use of such machines is generally directed to the manufacture of bent wire articles. In these machines the rotation of the bending means is produced, in each bending cycle, between the outgoing and incoming travel of the reciprocal movement of the bending means.

With this sequence of motions it is possible first to bring the bending means into lateral contact with the wire segment emerging from the distributor means, then to rotate it through a certain angle in one direction or the other so that it bends this wire segment about the exit point of the distributor means, and finally to retract it so as to allow the wire to advance for the next bending cycle. The degree of bending of the wire depends upon the angle through which the bending means rotate, whereas the length of the bent wire segment is determined by the pitch of the feed device.

The essential mechanical element used in the construction of a curving machine of this known type is formed by a cylindrical bending head whose axis of symmetry is perpendicular to the feed direction of the wire to be curved. On its face turned towards the outlet of the distributor means, this head supports the bending means properly speaking which is formed by a fixed finger off-centered with respect to the axis of symmetry of the head; the reciprocal movement of this bending means is provided by the action of a cylinder and piston device which moves the whole bending head whereas its angular rotation is produced by a stepper motor which causes the bending head to rotate about its axis of symmetry.

In this first known machine, the particular structure of the bending means and of the drive means therefor is the cause of a number of drawbacks.

The first of these drawbacks results from the considerable inertia of the bending head which opposes the translational movement of this latter by causing a delay in responding to actuation of the cylinder and piston device, which delay is prejudicial to the working speed and consequently to the productivity of the curving machine.

Another drawback is inherent in the motor for angularly rotating the bending head which is not sufficiently accurate for some applications of the curving machine.

But the main drawback of this known curving machine, as can be seen from the above description of its operation, resides in the fact that it can only produce wires whose bends extend in one and the same plane perpendicular to the axis of rotation of the bending means. In other words, it is not adapted to curving wires in all directions in space. Now, in numerous fields of application and more particularly in the manufacture of frames or skeletons for motor vehicle seats, metal wires are required bent according to a spatial configuration.

To manufacture such wires, multiple slide machines are at the present time available. In these machines, the slides which are mounted side by side on the frame of the machine comprise bending heads of different shapes cooperating with complementary counter matrices and may be orientated in any direction in space. Thus, a wire placed between the bending heads of the slides and the associated counter matrices may be curved, after actuating the slides, according to a spatial configuration which is defined by the orientation and the working travel of the slides as well as by the form of their bending head.

It will be readily understood that this multi-slide machine is only interesting for curving wires of great length.

Moreover, its efficieny is only effective in the case of large scale manufacture since, whenever it is desired to change the configuration or the bending pattern of the wire, it is necessary to replace the slides in position by slides specially adapted to the new manufacture contemplated, then to adjust the operation of these latter, this double operation possibly taking two to three hours. In addition, this multi-slide machine requires very expensive tooling.

SUMMARY OF THE DISCLOSURE

The present invention proposes overcoming all these drawbacks and, for this, it provides a curving machine of the type specified in the preamble which is characterized in that it further comprises means for generating a relative angular rotational movement between the bending means and the metal element about a second axis merging with the feed direction of the metal element, this relative angular rotational movement being synchronized with the other two movements of the bending means and the stepped feeding movement of the metal element.

With this arrangement, the axis of rotation of the bending means may be orientated in any direction, with respect to the metal element, within a plane perpendicular to the feed direction of this latter.

The bending means may consequently curve wires in any direction in space and the machine of the invention is able to produce, continuously and at a high rate, wires bent in any spatial configuration. It can thus be seen that the curving machine of the invention has all the advantages of the above-mentioned first known machine with bending in a single plane, without having the drawbacks of the mutli-slide machines for spatial bending.

In a preferred embodiment of the invention, the bending means are mounted for rotation about the second axis and the means for generating said relative angular movement are formed by a third drive mechanism under the action of which the bending means may be driven with an angular rotational movement about this axis.

This embodiment of the curving machine of the invention is more particularly adapted to the manufacture of articles made by bending a continuous metal element, each finished article being separated from this latter by shears which act at the outlet of the distributor means.

According to another characteristic of the invention, the distributor means is formed by a cylindrical barrel of circular section whose axis of symmetry forms said second axis and the bending means are formed by a bending finger slidably mounted in said rectilinear path in a support head which has an axis of symmetry forming the first axis and which is rotated about this axis inside a frame itself mounted for rotation about the distributor barrel, the first, second and third drive mechanisms acting respectively on the support head, the bending finger and the frame.

In comparison with conventional cylindrical bending heads, this bending finger is of very reduced weight and opposes a practically negligeable inertia to the actuation of its drive mechanism. Consequently, its reciprocal movement is instantaneous, which has a favorable influence on the work rate and the productivity of the curving machine of the invention.

In this case, the second mechanism for driving the bending finger comprises a piston and cylinder device firmly secured to the frame, the piston rod of which slides freely through the support head along the axis of rotation thereof, the free end of this rod being connected to the bending finger by a rotary lateral connection, which allows the bending finger to rotate about the rod of the piston and cylinder device while being moved with a translational movement by this latter, in any angular position.

In a preferred embodiment, the first mechanism for driving the bending finger comprises an endless chain driven parallel to the feed direction of the wire about two toothed wheels one of which is fixed coaxially about the support head and the other is supported by a free-running shaft mounted for free rotation on the frame parallel to the axis of rotation of the support head, one of the strands of the endless chain being connected to the free end of the rod of a piston and cylinder device which extends in the drive direction of the endless chain.

This method of rotating the bending means has the advantage, on the one hand, of being very accurate in so far as the repeatability of the bending angles is concerned and, on the other hand, of producing very small angular rotations which may be only of 1/10 of a degree.

To increase the degree of accuracy of this second drive mechanism, a silent endless chain is used and it is further provided for the free end of the rod of the piston to be mounted for sliding along a guide rail parallel to the rod.

Moreover, the third mechanism for driving the bending finger comprises a toothed wheel of large diameter firmly fixed to the frame and centered about the axis of rotation of this latter, this large diameter toothed wheel meshing with a toothed wheel of small diameter keyed to a shaft which is driven through a chain transmission without clearance by a stepper motor.

Finally, according to yet another feature of the invention, the different mechanisms for driving the bending means and the feed device are actuated in synchronism by a programmable digital control with assisted programming.

With this arrangement, the productivity of the machine of the invention may be considerably increased in the case of medium and even small scale manufacture. In fact, the operations of the drive mechanisms and of the feed device of the machine which determine the bending parameters are controlled in synchronism by a programme which contains a succession of digital instructions and which may be recorded on a conventional magnetic tape cassette. Thus, going over from one type of manufacture to another requires simply changing the cassette in the reading apparatus in the digital control cabinet which change may be effected in a very short time of the order of two minutes.

One embodiment of the curving machine of the invention will be described hereafter by way of non limiting example with reference to the accompanying drawings in which:

DESCRIPTION OF PREFERRED EMBODIMENTS

Such as it is shown in the accompanying figures, the machine which forms the subject of the present invention is specially designed for producing in succession bent wire articles, by curving a continuous metal wire. However, this is not a limitative application of this machine which, with a small number of structural modifications, may be used for producing articles made by bending any other type of thin and rectilinear metal elements of constant thickness, such as strips or tubes of small diameter.

This machine may also serve for curving single segments of elements of this type.

Figure 1:
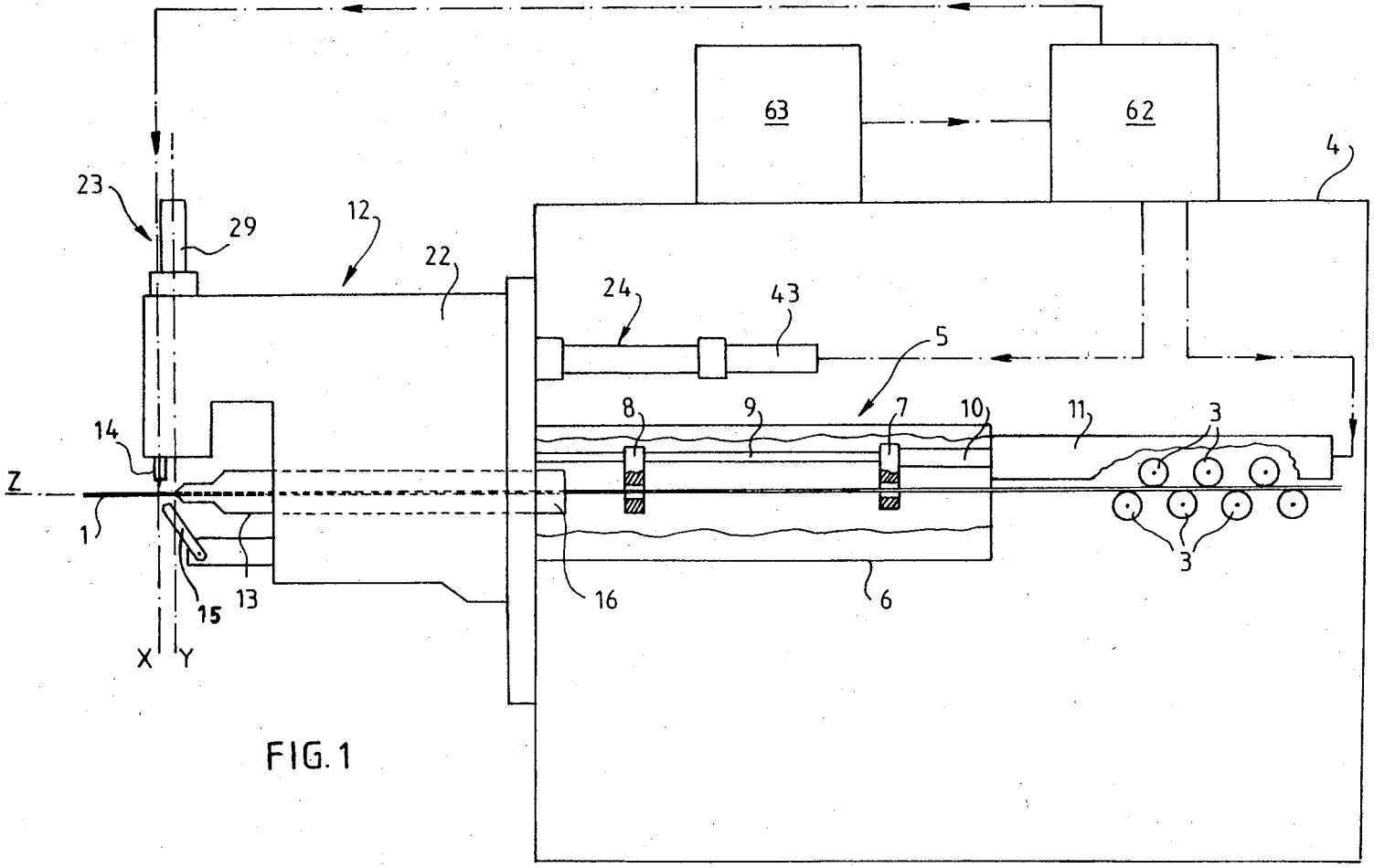
FIG. 1 is a schematical side view with parts cut away of the curving machine according to this embodiment of the invention.

As can be seen in FIG. 1, continuous metal wire 1 coming from a motor driven spool not shown passes first of all through a straightening device 2. This straightening device is formed of a number of rollers 3 mounted freely rotating on the frame 4 of the machine and disposed in a staggered arrangement in two parallel rows which define a passage for the wire 1. While being driven between the two rows of rollers, the wire which has a certain curvature on leaving the spool, is made rectilinear. The height of the passage defined by the two rows of rollers may be adjusted by known means depending on the diameter of the wire.

Aligned with and at the outlet of this straightening device is located a stepping feed device 5 housed in a casing 6 which is fixed to the frame 4 of the machine. This feed device 5 is formed of a mobile nipper 7 and a fixed nipper 8. The mobile nipper 7 is slidably mounted on a cylindrical rail 9 parallel to the feed direction of wire 1 and is fixed at the end of the rod 10 of a piston and cylinder device 11 supported by the casing 6. The fixed nipper 8 is firmly secured to the rail 9 in the vicinity of its end opposite the piston and cylinder device 11.

Opening and closing of the two nippers 7 and 8 are controlled by conventional means known per se.

In this feed device 5, the mobile nipper grips the wire 1 which enters the casing 6 through an aperture provided in the rear wall thereof. Then, with the fixed nipper 8 open, the mobile nipper 7, moved along rail 9 by piston 11 causes the wire 1 to advance over a distance determined by the travel of this latter. The fixed nipper is then closed and the piston brings the mobile nipper in the open position back to its starting point for a new cycle for feeding wire 1. Thus, the mobile nipper 7 causes the wire 1 to advance over a rectilinear path and in successive steps not necessarily identical, in the direction of the bending device 12 of the machine.

As can be seen in FIG. 1, this bending device comprises a cylindrical distributor barrel 13 with circular section, which is firmly secured to the frame of the machine and which extends in alignment with the feed device 5 so as to direct the wire 1, moved in translation by this latter, to the level of a mobile bending means 14 which provides the bending properly speaking of the wire segment emerging from the distributor barrel, about the outlet point from this latter. Shears 15 are further brought automatically, by an actuating system not shown, to the outlet point of the distributor barrel to separate each finished article of wire 1 by severing.

Figure 2:
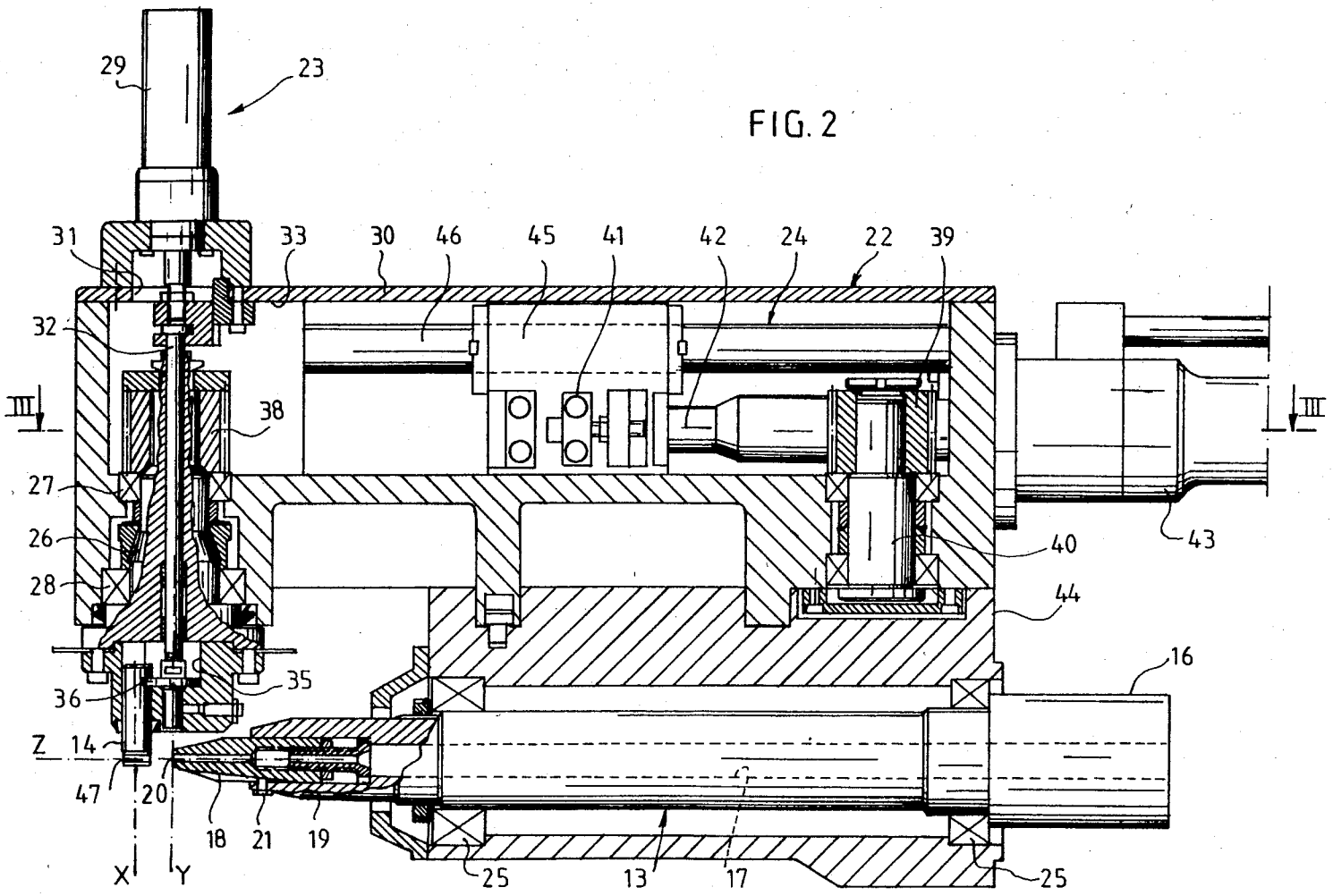
FIG. 2 is a sectional view of its bending device properly speaking, taken in the plane of FIG. 1.

As can be seen more clearly in FIG. 2, wire 1 which enters the distributor barrel 13 through the end 16 thereof, situated near the fixed nipper 8 of the feed device 5, is moved translationally inside a passage 17 extending along the longitudinal axis of barrel 13, before leaving the barrel through a tapered nozzle 18 removably mounted in the other end 19 of the barrel. The longitudinal passage 17 has a diameter substantially greater than the maximum diameter which the wire passing therethrough may have. On the other hand, the channel 20 of nozzle 18 has a diameter strictly equal to that of the wire to be bent so that this latter may slide without play inside the nozzle. Consequently, an assembly of nozzles may be provided adapted for each wire diameter to be bent. The chosen nozzle is fixed to the end 19 of barrel 13 by a screw 21 but, as a variant bayonet fixing means may be provided for the same purpose.

As is further shown in FIG. 2, the mobile bending means 14 are supported by a frame 22 so as to be disposed opposite and very close to the outlet point of nozzle 18. Under the action of a first drive mechanism 24, the bending means 14 may be driven with an angular rotational movement about an axis Y which extends perpendicularly to the direction of wire 1 in alignment with the outlet point of the distributor barrel 13. Moreover, a second drive mechanism 23 moves the bending means 14 with a reciprocal movement over a rectilinear path X parallel to axis Y. By combining its two movements, the bending means 14 may be brought into lateral contact with the wire segment leaving barrel 13, then bend it through a certain angle in one direction or the other about the tip of nozzle 18. But as will be readily understood, bending means only having these two possibilities of movement may only bend the wire in a plane perpendicular to its axis of rotation.

This is why, according to the main feature of the present invention, the frame 22 which supports the bending means 14 is mounted for rotation about the cylindrical distributor barrel 13 by means of two bearings 25 and may be driven with an angular rotational movement transmitted by a third drive mechanism which will be described further on with reference to FIG. 4. Thus, the bending means 14 has a third possibility of movement which consists of an angular rotation about a second axis merging with the longitudinal axis of symmetry of the passage 17 of barrel 13, i.e. with the feed direction of wire 1. By combining this third movement with the first two, the bending means 14 may curve wire 1 in any direction in space and the machine of the invention may produce wires bent according to a spatial configuration.

According to a second feature of the present invention, the bending means 14 are formed by a cylindrical finger mounted for sliding along the path X in the support head 26 which is itself secured for rotation inside the front part of frame 22 through two bearings 27, 28. The bending finger 14 is off-centered with respect to the axis of symmetry of the support head 26, which forms in fact the above-mentioned axis of rotation Y.

Under the action of the second mechanism 23, the bending finger 14 may be either extended from its support head 26 for positioning thereof against wire 1, or retracted to allow feeding of wire 1 at the end of a bending cycle. It can be seen that, because of its reduced weight, the bending finger 14 opposes a practically negligeable inertia to the action of the drive mechanism 23; its reciprocal movement is consequently instantaneous which results in increasing the work rate and the productivity of the curving machine of the invention.

The drive mechanism 23 comprises more precisely a hydraulic cylinder 29 fixed to the upper wall 30 of frame 22 in which is formed an aperture 31 through which passes the rod 32 of the piston. Piston rod 32 slides freely through the support head 26 along axis Y and, at its free end, emerges into an inner cavity 35 of the support head where it is connected to the bending finger 14 by a rotary connection 36. With this connection, finger 14 may be rotated about axis Y while being able to be moved in translation by rod 34 whatever its angular position.

The first mechanism 24 for driving the bending finger 14 which imparts thereto this angular rotational movement about axis Y is housed in an inner cavity 33 of frame 22.

Figure 3:
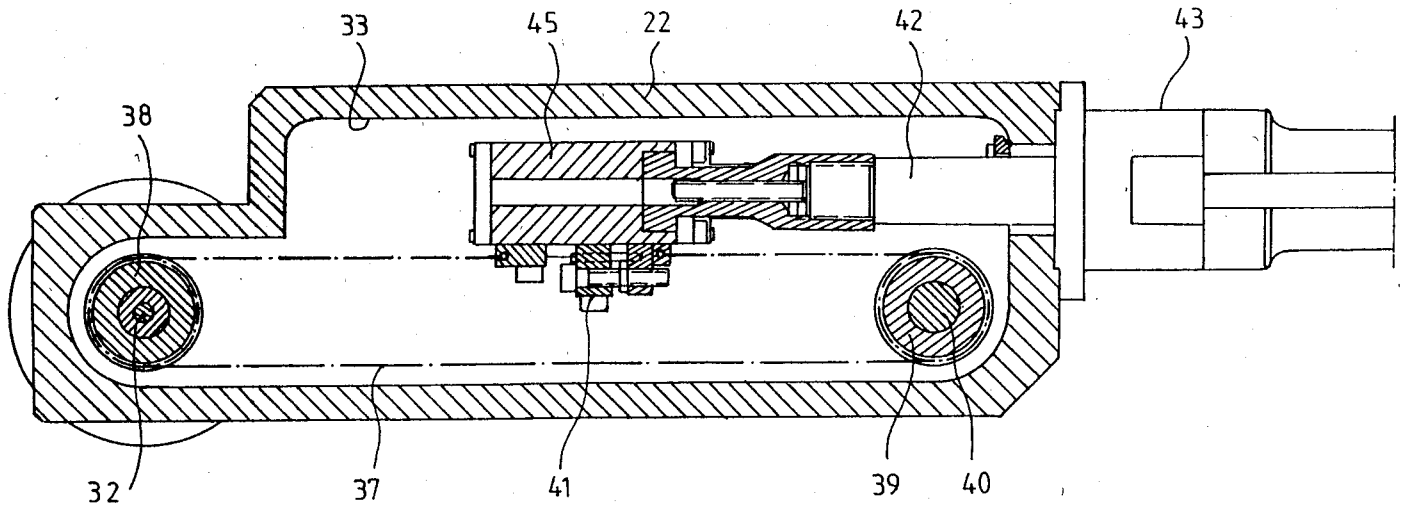
FIG. 3 is a sectional view through III—III of FIG. 2.

Referring both to FIGS. 2 and 3, this first drive mechanism 24 may be seen which comprises first of all an endless chain 37 which has not been shown for greater clarity in FIG. 2. This endless chain 37, which is preferably a silent chain, cooperates with two toothed wheels 38, 39 one of which is fixed coaxially about the support head 26 and the other 39 is supported by a free-running shaft 40, held for rotation in frame 22 so that its axis of rotation is parallel to that of the support head. The two strands of the endless chain 37 are thus parallel to the feed direction of wire 1 and one of them is connected by a connection link 41 to the end of rod 42 of the piston of a hydraulic cylinder 43 fixed to the rear face 44 of frame 22. The free end of the piston rod 42 is further mounted for sliding, by means of a ball-bearing socket 45, along a cylindrical rail 46 parallel to the feed direction of the wire and fixed by its ends to frame 22. It will be understood that, with this mechanism, the endless chain 37, driven in one direction or the other by the cylinder 43, causes the support head 46 to rotate through an angle determined by the travel of the piston rod, this angular rotation being transmitted to the bending finger 40 which describes an arc of a circle with the same angle at the center about axis Y. Thus, the bending finger 14, in lateral contact with wire 1, may bend this latter in a plane perpendicular to axis Y, the degree of bending obtained being directly dependent on the travel of the rod of piston and cylinder device 43.

It should be noted here that this second drive mechanism is of very high precision. It allows very small angular rotations of the bending finger to be produced, of the order of 0.1 degree, which allows this latter to achieve bends along non polygonal curves and more especially along arcs of circles.

Finger 14 exerts its bending action on wire 1 through a V shaped groove 47 which adapts itself to all wire diameters. The bending finger is further mounted with the rotary connection 36 inside a removable cover 48 which is fixed to the rotary head, the rotary connection being connected by snap-fit to the free end of rod 32.

The bending plane of wire 1 is determined, before the finger 14 comes into action, by the third drive mechanism 49 which will now be described with reference to FIG. 4.

As can be seen, this third drive mechanism 49 comprises a toothed wheel of large diameter 50 firmly fixed to frame 22 and centered about the axis of rotation 7 of this latter. Toothed wheel 50 meshes with a smaller diameter toothed wheel 51 which is keyed to a fixed shaft 52 and which is driven by a stepper motor (only the shaft 54 of which is shown in FIG. 4), through a silent chain transmission 53 forming a reducer without play. The chain transmission 53 comprises an endless chain 55 running around two toothed wheels 56,57 fixed respectively to the shaft 52 of the small toothed wheel and the shaft 54 of the motor. The endless chain 55 is further tensioned by an adjustable tension roller 58.

It will be understood that, in this third drive mechanism 49, a given angular movement of the large toothed wheel 50 about the axis of rotation Z orientates the axis of rotation Y systematically in the desired direction and so the bending plane of wire 1 which is thus determined by the rotational pitch of the motor.

The assembly formed by the chain transmission 53, the small toothed wheel 51 and the stepper motor is housed inside a protecting cover 59 which is partially open at the level of the meshing of the toothed wheels 50 and 51 and may be moved perpendicularly to their axis of rotation for adjusting the between tooth clearance.

Figure 4:
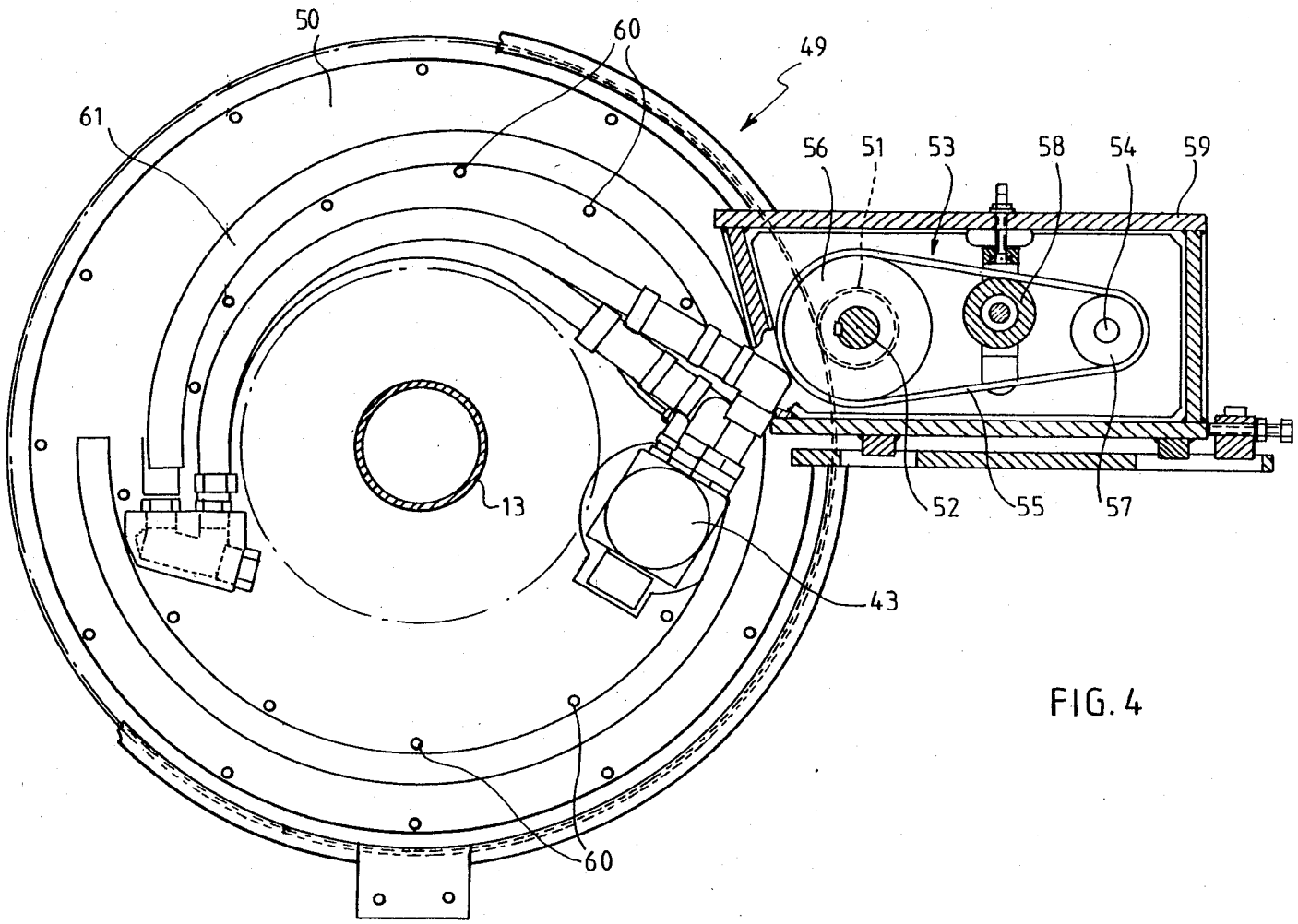
FIG. 4 is a view representing partially in section the third drive mechanism of the curving machine of the invention.

In FIG. 4, there are further shown bearing studs 60 disposed in a spiral and around which the pipe 61 for supplying pressurized hydraulic fluid to the piston and cylinder device 43 is wound during the different rotations of wheel 50.

The different piston and cylinder devices 11, 29 and 43 of the curving machine of the invention are, as can be seen in FIG. 1, fed with pressurized fluid by a hydraulic unit 62 under the control of a digital control panel shown schematically by a square with reference 63. The motor for rotating frame 22 as well as the device for actuating shears 15 are also controlled by this digital control panel.

The digital control panel comprises a reading apparatus into which may be introduced a magnetic tape cassette on which a programme is pre-recorded in the form of a succession of digital instructions which govern and synchronize the operations of the different drive mechanisms 23,24,29 of the feed device 5 and of the device for actuating the shears 15 of the machine depending on the type of bent wire article it is desired to produce.

More precisely, these instructions are relative, for each bending cycle, to the speed and the angle of rotation of the bending finger 14 about the two axes Y,Z, to the length and the speed at which the wire is fed, to the diameter of this latter and to the time when shears 15 are actuated.

The programme further allows automatic location of the origins of the different movements of the curving machine and troubleshooting.

It will be readily understood that this programmable digital control considerably increases the efficiency in the case of medium or small scale manufacture, since a change in the type of manufacture only requires replacement of one programme-cassette by another. The programme for an article may further be displayed on a standard video screen in the form of a table and the operator has the possibility of modifying any parameter of the table by means of the slider of the video screen.

The particularly high work rate of the curving machine of the invention should also be emphasized. By way of illustration, it may be mentioned that the rotational speeds of the bending finger about axes Y and Z may reach respectively 277 rpm and 66 rpm and that the feed speed of the wire may reach 1 m/s.

Among the advantages of the curving machine of the invention, its great flexibility in use may also be mentioned. In fact, it may bend not only metal wire whose diameter may reach 8 mm but also metal strips or ribbons. For bending strips or ribbons, it is of course necessary to adapt accordingly the form of the central passage 17 of the distributor barrel 13 and of the channel 20 of nozzle 18. The machine of the invention may even produce bent tubes, more particularly because of the very high accuracy of the second drive mechanism 24 of the bending finger 14, which allows curving through an arc of a circle by successive approximate touches.

We claim:

1. An automatic machine for curving, in a predetermined configuration, thin rectilinear metal elements of constant thickness of the wire, strip or tube kind, the machine comprising:

a distributor means (13) having an outlet through which a metal element to be curved (1) may be moved with a stepped feed movement along a feed path by means of a feed device (5);

bending means (14) situated downstream and in the vicinity of the outlet of the distributor means (13) and which:

by means of a first drive mechanism (24), are driven with an angular rotational movement about an axis (Y) perpendicular to the direction of the feed path of the metal element and, by means of a second drive mechanism (23), are moved with a reciprocal movement over a rectilinear path (X) parallel to this axis (Y);

the operations of the first and second drive mechanisms (24, 23) being synchronized to that of the feed device (5) according to a predetermined cycle;

the curving machine being further characterized in that:

it further comprises means for generating a relative angular rotational movement between the bending means (14) and the metal element (1) about a second axis (Z) merging with the feed path of the metal element, this relative angular rotational movement being synchronized with the other two movements of the bending means and the stepped movement for feeding the metal element;

the bending means (14) are mounted for rotation about the second axis (Z); and the means for generating said relative angular movement are formed by a third drive mechanism (49) under the action of which the bending means (14) may be driven with an angular rotational movement about this axis (Z).

2. The curving machine according to claim 1, characterized in that the distributor means (13) are formed by a cylindrical barrel of circular section whose axis of symmetry forms said second axis (Z), and in that the bending means (14) is formed by a bending finger mounted for sliding, over said rectilinear path (X), in a support head (26) which has an axis of symmetry forming the first axis (Y) and which is held for rotation about this axis inside a frame (22) itself mounted for rotation about the distributor barrel (13), the first, second and third drive mechanisms (24,23,49) acting respectively on the support head (26), the bending finger (14) and the frame (22).

3. The curving machine according to claim 2, characterized in that the second mechanism (23) for driving the bending finger (14) comprises a piston and cylinder device (29) firmly fixed to the frame whose piston rod (32) slides freely through the support head (26) along the axis of rotation (Y) of this latter, the free end of this rod (32) being connected to the bending finger (14) by a rotary lateral connection (36).

4. The curving machine according to claim 2, characterized in that the first mechanism (24) for driving the bending finger (14) comprises an endless chain (37) extending parallel to the feed direction of the wire about two toothed wheels (38,39) one of which (38) is fixed coaxially about the support head and the other (39) is supported by a free-running shaft (40) mounted for free rotation on the frame (22), in parallel to the axis of rotation (Y) of the support head, one of the strands of the endless chain (37) being connected to the free end of the rod (42) of a piston and cylinder device (43) which is parallel thereto.

5. The curving machine according to claim 4, characterized in that the endless chain (37) is a silent chain.

6. The curving machine according to claim 4, characterized in that the free end of the rod (42) of the piston and cylinder device (43) is mounted for sliding along a guide rail (46) parallel to the rod (42).

7. The curving machine according to claim 2, characterized in that the third drive mechanism (49) for driving the bending finger comprises a toothed wheel of large diameter (50) firmly fixed to the frame (22) and centered about the axis of rotation (7) of this latter, this toothed wheel of large diameter meshing with a smaller diameter toothed wheel (51) keyed to a shaft (52) and driven, through a chain transmission without play by a stepper motor.

8. The curving machine according to claim 1, characterized in that the different drive mechanisms (23,24,49) for driving the bending means (14) and the feed device (5) are actuated in synchronism by a programmable digital control with assisted programming.

9. An automatic machine for curving, in a predetermined configuration, a thin rectilinear metal element (1) such as wire, strip or tube, the machine comprising:

feed means (5), including an outlet, for moving such metal element (1) through the outlet with a stepped feed movement in a feed direction;

bending means (14) mounted for rotation downstream from and near the feed-means outlet;

a first drive mechanism (24) for rotating the bending means about a first axis (Y) that is perpendicular to the feed direction;

a second drive mechanism (23) for reciprocating the bending means along a rectilinear path (X) that is parallel to the first axis (Y); and a third drive mechanism (49) for rotating the bending means (14), relative to such metal element (1), about a second axis (Z) that is parallel to the feed direction;

the operation of the first, second and third drive mechanisms (24, 23) being synchronized with that of the feed device (5).

10. The curving machine of claim 9, wherein:

the feed means (5) include a circular-cylindrical barrel (13) having a centerline substantially at the second axis (Z);

the bending means (14) include:

a frame (22), mounted for rotation about the barrel (13), a support head (26) held for rotation inside the frame (22) about the first axis (Y), and a bending finger (14) mounted for sliding, within the support head, along said rectilinear path (X); and the first, second and third drive mechanisms (24, 23, 49) act respectively on the support head (26), the bending finger (14), and the frame (22).

11. The curving machine of claim 10, wherein:

the second drive mechanism (23) includes a piston-and-cylinder device (29) firmly fixed to the frame and having a piston rod (32);

the piston rod (32) slides freely through the support head (26) along the first axis (Y) and has a free end; and the free end of the piston rod has a rotary lateral connection (36) to the bending finger (14).

12. The curving machine of claim 10, wherein the first drive mechanism (24) includes:

a free-running shaft (40) mounted for free rotation on the frame (22) about an axis parallel to the first axis (Y);

a first toothed wheel (38) fixed coaxially about the support head;

a second toothed wheel (39) supported by the shaft (40);

an endless chain (37) encircling the first and second toothed wheels, extending parallel to said feed direction; and a piston-and-cylinder device (43) having a piston rod (42) with a free end that is connected to the endless chain (37).

13. The curving machine of claim 12, wherein:

the endless chain (37) is a silent chain.

14. The curving machine of claim 12, wherein:

the free end of the piston rod (42) is mounted for sliding along a guide rail (46) parallel to the rod (42).

15. The curving machine of claim 10, wherein the third drive mechanism includes:

a stepper motor;

a chain transmission driven by the stepper motor;

a shaft (52) driven by the stepper motor through the chain transmission with substantially no play;

a large-diameter toothed wheel (50) keyed to the shaft for rotation therewith; and a smaller-diameter toothed wheel (51) meshed with the large-diameter wheel (50) and firmly fixed to the frame (22) for rotation about the axis of rotation of the frame (22).

16. The curving machine of claim 9, wherein:

all three drive mechanisms (23, 24, 49) and the feed device (5) are actuated in synchronism by a programmed digital controller.

* * * * *